United States Patent [19]

Stern et al.

[11] 4,356,788

[45] Nov. 2, 1982

[54] DEEPWATER PROPELLANT EMBEDDED ANCHOR HAVING EMERGENCY RELEASE MECHANISM

[75] Inventors: Melvin Stern, Ventura; Daniel G. True, Camarillo, both of Calif.

[73] Assignee: The United States of America as represented by the Secretary of the Navy, Washington, D.C.

[21] Appl. No.: 258,128

[22] Filed: Apr. 27, 1981

[51] Int. Cl.[3] ..... B63B 21/28

[52] U.S. Cl. ..... 114/295

[58] Field of Search ..... 114/295, 294, 301; 89/1 B, 1 G; 102/411, 413; 405/224, 234; 52/155

[56] References Cited

U.S. PATENT DOCUMENTS 3,170,433 2/1965 Gardiner ..... 114/295

3,910,218 10/1975 Taylor et al. ..... 114/295

*Primary Examiner*—Sherman D. Basinger

*Attorney, Agent, or Firm*—Robert F. Beers; Joseph M. St.Amand

[57] ABSTRACT

A deepwater propellant embedded anchor system having emergency release mechanism for separating an anchor fluke assembly from the gun assembly. In an emergency, a sear pin is rotated by a lever and release line to disengage the fluke assembly, thus allowing the fluke assembly and explosive cartridge to drop away and allow water to flood the gun barrel and soak the primer for disarming the anchor system.

12 Claims, 4 Drawing Figures

DEEPWATER PROPELLANT EMBEDDED ANCHOR HAVING EMERGENCY RELEASE MECHANISM

BACKGROUND OF THE INVENTION

This invention is related to propellant embedded anchors and in particular to an improved propellant embedded anchor system having an emergency release mechanism for safely separating the anchor projectile assembly and explosive cartridge from the gun assembly to disarm the system when a malfunction or misfire occurs.

Prior to the present emergency release mechanism, when a misfire occurred while the hydrostatic lock of the propellant embedded anchor's safe-and-arm device was in an armed position, an explosive ordnance disposal team was required to remove the safe-and-arm device and disarm the anchor's explosive mechanism. In other instances of misfire it was necessary to cut the lowering lines and lose the entire anchor and rigging.

With the present system such unsafe and costly occurrences are avoided. An explosive ordnance disposal team does not have to remove the explosive cartridge from the gun barrel, and seawater is used to flood the gun barrel to soak and disarm the primer. Also the anchor need not have to be disposed of and lost by cutting the lowering lines.

SUMMARY OF THE INVENTION

This improved propellant embedded marine anchor includes an emergency release device used to safely separate the anchor projectile from the gun assembly for the purpose of disarming the system when a misfire occurs. The anchor projectile is connected to a pair of anchor link rods, each of which are attached to rod guides that are locked in place by means of respective rotatable sear pins. The sear pins are each attached to a lever mechanism which in turn is attached to a release line. An upward force on the release line will cause the sear pins to be rotated releasing the anchor link rods and allowing the anchor projectile to fall away, and the drive piston and explosive cartridge to drop, free from the gun barrel, wherein seawater will flood the gun barrel and penetrate the primer for completely disarming the anchor system.

BRIEF DISCRIPTION OF THE DRAWINGS

DESCRIPTION OF THE PREFERRED EMBODIMENTS

Figure 1:
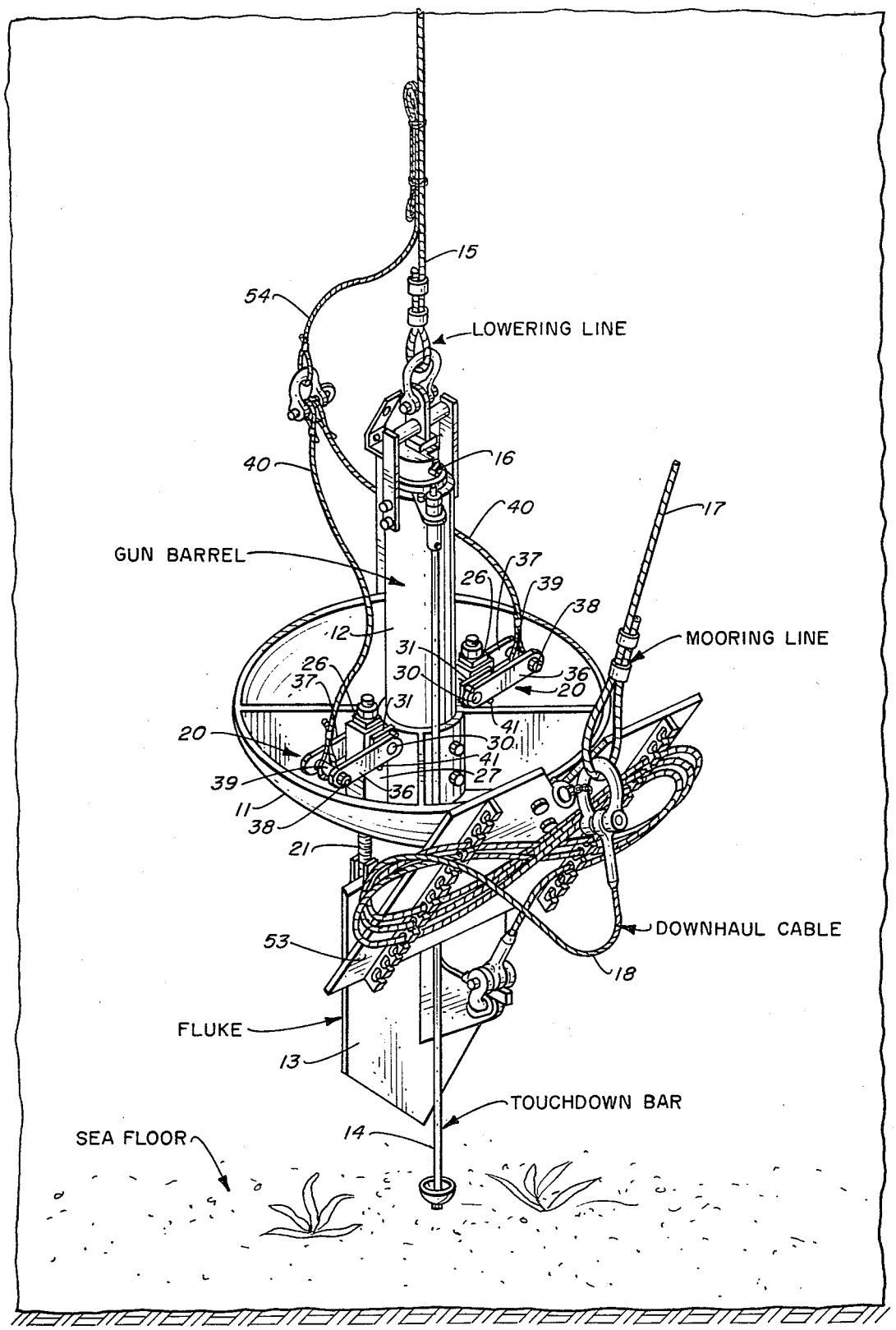
FIG. 1 is an overall perspective view of a preferred embodiment of the invention showing a propellant embedded marine anchor assembly equipped with emergency release mechanisms.

Referring now to the drawings, like numerals refer to like parts in each of the drawings.

In the propellant embedded anchor embodiment shown in FIG. 1, the anchor rigging which includes a reaction vessel 11, a gun barrel 12, a fluke 13, and a touchdown bar 14, is lowered to the seafloor by means of a lowering line 15. When touchdown bar 14 is pushed upwards from force against the seafloor, as it is lowered, it actuates safe-and-arm device 16 which in turn fires an explosive cartridge in gun barrel 12 forcing fluke 13 to be propelled downward and embedded into the seafloor. Reaction vessel 11 operates to reduce upward movement of the gun assembly (11, 12, 14, 16) when the explosive cartridge in gun barrel 12 is fired. The ship or other device to be moored is connected to mooring line 17 and downhaul cable 18 which is attached to the anchor fluke. If the explosive cartridge in the gun barrel does not fire when the touchdown bar is actuated, the anchor assembly must be retrieved with minimum danger to personnel.

A pair of emergency release mechanisms 20, provided in case of an ordnance failure or safe-and-arm malfunction, are located in reaction vessel 11, as shown in FIG. 1. Release lines are used to operate respective release mechanisms 20.

Figures 2, 3, 4:
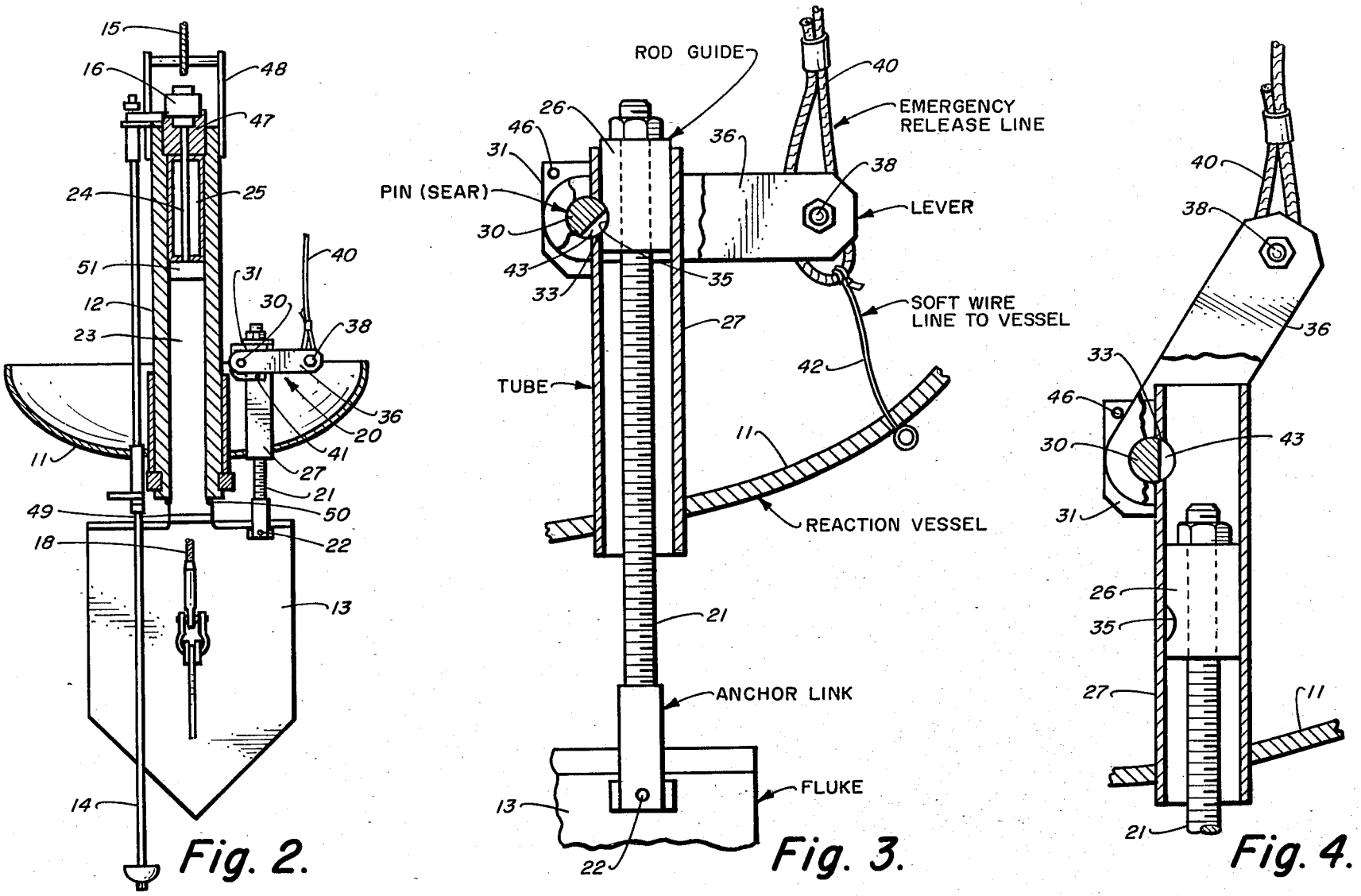
FIG. 2 shows a vertical, partially cutaway view of the propellant embedded anchor shown in FIG. 1.
FIG. 3 shows in detail a partial cross-sectional view of a preferred embodiment of the emergency release mechanism, in a locked position.
FIG. 4 shows the device of FIG. 3 in a released position.

Details of the emergency release mechanism 20 are shown in more detail in FIGS. 2, 3 and 4. For simplicity, only a single emergency release mechanism 20 is shown in FIG. 2. Each release mechanism assembly comprises a release rod and anchor link 21 having its lower end connected to the anchor fluke 13 by means of a shear pin 22, for example. As shown in FIG. 2, fluke 13 is connected to piston 23 which fits within gun barrel 12. A primer 24 loaded with a fast burning powder fits into a central perforated tube within cartridge 25 and runs its full length. When the primer is set off by actuation of touchdown bar 14 and safe-and-arm device 16 the propellant in cartridge 25 is ignited along its full length. The propellant cannot be ignited without the primer which is set off by the impact of a firing pin within the safe-and-arm device. When the primer 24 is fired and explodes cartridge 25, piston 23 is propelled from the gun barrel, shearing pins 22 and causing fluke 13 to be embedded into the seafloor. If there is a misfire or the safe-and-arm device malfunctions the anchor system must be safely disarmed so it can be used again.

The upper end of release rod and anchor link 21 is provided with a rod guide 26 of square-shaped cross-section, for example, which is operable to slide within a tube 27, of similar cross-section, mounted on reaction vessel 11. Rod guide 26 is also operable to be supported and locked in position at the upper end of tube 27 by means of a rotatable sear pin 30. Sear pin 30 is supported by a pair of brackets 31 which are attached to opposite sides of tube 27. Brackets 31 horizontally position sear pin 30 within a horizontal notched opening 33 formed in the side of tube 27, allowing a portion of sear pin 30 to extend within tube 27 when in a locking position as shown in FIG. 3. The portion of sear pin 30 which extends into tube 27 also fits within a groove 35, formed in the side of rod guide 26, and operates to lock the rod guide in the position shown. A lever comprising a pair of members 36 and 37, each having one end attached to opposite ends of sear pin 30, is used to operationally rotate the sear pin about its horizontal axis. The other ends of lever members 36 and 37 are joined together by means of a bolt 38 and sleeve 39 (see FIG. 1) to which emergency release line 40 is attached. When the emergency release mechanism is in its normally locked position, the bottom of lever 36, 37 rests on stop pin 41, shown in FIGS. 1 and 2.

As shown in FIG. 3, a soft wire line 42 is connected between reaction vessel 11 and emergency release line 40 to prevent accidental operation of the release mechanism 20. By pulling on the emergency release line 40, soft wire line 42 is broken and lever 36, 37 is moved upward rotating sear pin 30, as shown in FIG. 4. Sear pin 30 has a portion 43 removed so that when it is rotated, by moving the lever upward, the sear pin will clear groove 35 in rod guide 26 allowing the rod guide, and release rod and anchor link 21 to slide out from tube 27 and drop free. A stop pin 46 prevents the lever from rotating the sear pin beyond the release position.

The gun assembly consists of gun barrel 12, a breech block 47, and reaction vessel 11. The gun barrel is the heart of the anchor assembly since the breech block, safe-and-arm device, primer, cartridge and piston are all mounted on it or in it. The lifting harness 48 and reaction vessel are also attached. Breech block 47 is threaded into the upper end of the gun barrel and functions to confine the pressure generated by the burning propellant of cartridge 25 by blocking one end of the gun barrel. Piston 23, inserted into the lower end of the gun barrel, serves to transmit the gas force from the burning propellant to the fluke 13. The lower end of piston 23 is mateable with the upper end of fluke 13 at 49. An O-ring seal 50 mounted above a flange on the lower end of the piston effectively keeps seawater out of the gun barrel until fired.

The recoil forces generated by firing the propellant charge cartridge 25 are transmitted to the reaction vessel. The cup shape of the vessel traps water to increase the mass of the gun assembly during firing. As previously mentioned, the cup shape also acts as a drag cone to slow the upward motion of the gun assembly and limit recoil height. Release rod and anchor links 21 are used to draw and hold fluke 13 against the lower end of piston 23. The lower ends of release rod and anchor links 21 are attached to the anchor fluke blade with shear pins 22. If desired, a filler 51 can be used to adjust the gun barrel chamber volume in order to obtain optimum gun performance with flukes of different weights.

In normal operation, the fluke assembly is separated from the gun assembly by firing cartridge 25 and shearing the pins 22 which connect the fluke assembly to the release rod and anchor links 21. Since release rod and anchor links 21 are the only elements retaining the fluke assembly to the anchor assembly, when the emergency release mechanism is actuated, fluke 13, including piston 23, and cartridge 25 all drop free of the gun assembly. Seawater than floods the gun barrel and soaks the primer 24. The anchor is now disarmed.

Piston 23 is separable from fluke 13 after being released or expelled from gun chamber 12, and, if desired, can be connected to reaction vessel 11 with a lanyard for ease in recovery. Fluke 13 is retrieved with mooring line 17 and downhaul cable 18.

In order to accommodate the separation of the fluke from the gun barrel assembly upon firing, downhaul cable 18 and faking board 53 (shown in FIG. 1) are used. Downhaul cable 18 is attached at one end to fluke 13, and the tag end is shackled to mooring line 17. The downhaul cable must be of sufficient length to accommodate fluke penetration into the seafloor and recoil of the gun barrel assembly, and must remain slack at maximum penetration and recoil. As shown in FIG. 1, downhaul cable 18 is faked in a figure-8 lay on a plywood structure faking board 53 that disintegrates when the cable is pulled out during firing. This faking method allows the cable to pay out without kinking. The cable holding points on the plywood structure offer low resistance at breakaway. Different fluke configurations can be used for various types of seafloors in order to gain maximum holding power.

Release lines 40 to each of the two emergency release mechanisms 20 are joined to a single line 54 which is, in turn, taped to the lowering line 15 at some distance above the anchor rigging, as shown in FIG. 1. To operate the emergency release mechanisms 20, the anchor rigging is raised until single release line 54 can be recovered. Then the anchor rigging is lowered placing a strain on emergency release lines 40. When the weight of the anchor is borne by the emergency release lines 40, the strain breaks the soft wires 42, raises both levers and rotates sear pins 30 to clear the rod guides; the fluke, piston and cartridge then will drop clear of the reaction vessel and gun chamber.

The propellant embedded anchor system having emergency release mechanisms, such as disclosed herein, operates to provide safety and economy in the use and operation of explosive embedded anchors in case of ordnance failure or safe-and-arm malfunction. This permits retrieval of anchor rigging for further use with minimum danger to personnel.

Obviously, many modifications and variations of the present invention are possible in the light of the above teachings. It is therefore to be understood that within the scope of the appended claims the invention may be practiced otherwise than as specifically described.

What is claimed is:

1. A propellant embedded anchor system having an emergency release mechanism for safely disarming the system in case of malfunction or misfire, comprising:

a. a gun assembly, including:
   a gun barrel;
   an explosive charge within said gun barrel; and
   a firing means operable to detonate said explosive charge within the gun barrel;

b. a fluke assembly, including:
   an anchor fluke means;
   a mooring means connected to said anchor fluke means; and
   a piston means fitting within the open end of said gun barrel and having one end thereof extending from the open end of said gun barrel and mated with one end of said anchor fluke means; said piston means being operable to be forcefully expelled from said gun barrel upon firing the explosive charge in said gun barrel to propel said anchor fluke means into the seafloor;

c. an emergency release means mounted on said gun assembly and connecting said gun assembly to said fluke assembly; said emergency release means including at least one release mechanism;

d. each said at least one release mechanism, comprising:
   an elongated anchor link means having an upper end and a lower end; the lower end of said anchor link means being connected to said anchor fluke means with a break-away means; said break-away means being operable to be sheared by the force of said piston means against said anchor fluke means when said explosive charge is fired to propel said piston means from the gun barrel and embed said anchor fluke means into the seafloor;
   a vertical guide channel mounted on said gun assembly;

the upper end of said elongated anchor link means being operable to slidingly fit within said vertical guide channel;

the upper end of said vertical guide channel being provided with a latch means; said latch means, when in a locked position, operating to lockingly engage the upper end of said elongated anchor link means; and disengage means which, when actuated, is operable to unlock said latch means from the upper end of said anchor link means for allowing said anchor link means to slide free from said vertical guide channel;

whereby release of the upper end of said anchor link means permits said anchor fluke means to fall away from said gun assembly allowing said piston means and said explosive charge to fall out of said gun barrel and permit seawater to enter the gun barrel thereby disarming said gun assembly.

2. A device as in claim 1 wherein said anchor link means is adjustable and operable to draw up said one end of said anchor fluke means into a mated position against the end of said piston means which extends from the open end of said gun barrel.

3. A device as in claim 1 wherein said disengage means is operable to be actuated remotely at a safe distance from said gun assembly.

4. A device as in claim 1 wherein said disengage means is remotely operated by means of an emergency release line connected thereto.

5. A device as in claim 1 wherein the upper end of said elongated anchor link means is provided with an enlarged guide end which is operable to readily slide from said vertical guide channel when said latch means is disengaged.

6. A device as in claim 5 wherein the enlarged guide end of said elongated anchor link means is provided with a groove which engages with said latch means for locking said elongated anchor link means in said vertical guide channel.

7. A device as in claim 1 wherein said latch means which engages the upper end of said elongated anchor link means, comprises a sear pin rotatably mounted in a notched opening in the upper end of said vertical guide channel and a means for rotating said sear pin to either engage or disengage a groove which is provided in the upper end of said elongated anchor link means.

8. A device as in claim 1 wherein said gun assembly also includes a cup-shaped reaction vessel mounted about said gun barrel; said cup-shaped reaction vessel being operable to trap water to increase the mass of the gun assembly during firing and acting as a drag cone to slow the upward motion of the gun asembly and limit recoil height.

9. A device as in claim 1 wherein said emergency release means comprises a pair of release mechanisms connected to opposite sides of the upper end of said anchor fluke means.

10. A device as in claim 1 wherein the upper end of said gun barrel is provided with a harness means and lowering line whereby said anchor system is lowered to the seafloor.

11. A device as in claim 1 wherein said gun assembly includes a touchdown means which is operable to actuate 4aid firing means to detonate said explosive charge when said touchdown means pushes against the seafloor as said anchor system is lowered.

12. A device as in claim 11 wherein said touchdown means comprises a movably mounted elongated vertical touchdown bar which extends from said firing means to a point located at a desired distance below the bottom of said anchor fluke means; the lower end of said touchdown bar having a foot means thereon for pressing against the seafloor; the upper end of said touchdown bar operable to actuate said firing means when said touchdown bar is moved upward by force against the seafloor.

* * * * *